United States Patent [19]

Schneider

[11] 4,246,848

[45] Jan. 27, 1981

[54] SKI LIFT WITH SWIVEL CHAIR

[76] Inventor: Donald C. Schneider, 342 St. Joseph, Long Beach, Calif. 90814

[21] Appl. No.: 33,673

[22] Filed: Apr. 26, 1979

Related U.S. Application Data

[63] Continuation of Ser. No. 930,530, Aug. 2, 1978, abandoned, which is a continuation of Ser. No. 865,993, Dec. 30, 1977, abandoned, which is a continuation of Ser. No. 718,021, Aug. 26, 1976, abandoned.

[51] Int. Cl.[3] ..... B61B 11/00

[52] U.S. Cl. ..... 104/173 ST; 104/75; 105/156; 105/329 SC; 272/40; 297/349

[58] Field of Search ..... 104/53, 74, 75, 89, 104/93, 94, 95, 173 R, 173 ST; 105/148, 150, 154, 155, 156, 242, 329 S, 329 SC; 297/184, 349; 272/36, 39, 40, 42, 43

[56] References Cited

U.S. PATENT DOCUMENTS

| | | | |
|---|---|---|---|
| 1,447,895 | 3/1923 | Schafer | 104/75 X |
| 2,469,069 | 5/1949 | Grazier | 105/148 |
| 2,471,347 | 5/1949 | Rayburn | 105/156 X |
| 3,456,980 | 7/1969 | Battistoni et al. | 297/184 |
| 3,981,248 | 9/1976 | Savage | 104/173 ST |
| 4,003,314 | 1/1977 | Pearson | 104/173 ST X |
| 4,050,385 | 9/1977 | Gurr et al. | 104/173 ST |

FOREIGN PATENT DOCUMENTS

| | | | |
|---|---|---|---|
| 170678 | 3/1952 | Austria | 104/89 |
| 851817 | 10/1952 | Fed. Rep. of Germany | 104/173 ST |
| 879113 | 6/1953 | Fed. Rep. of Germany | 104/173 ST |

*Primary Examiner*—Randolph A. Reese

*Attorney, Agent, or Firm*—Knobbe, Martens, Olson, Hubbard & Bear

[57] ABSTRACT

There are disclosed improvements in the passenger unit for a ski lift such as a chair and the like to incorporate a swivel mechanism in the standard which supports the lift chair from the traveling, overhead cable. The swivel mechanism includes a swivel actuator which can be a hydraulic system to rotate the chair, permitting the occupant to rotate from a forward facing position and turn his back to wind, driving snow and the like or to change his direction of view. The ski lift also includes a mechanism for automatically restoring the forward direction of the passenger unit at the disembarking station or at any other preselected portion along the ski lift.

8 Claims, 9 Drawing Figures

SKI LIFT WITH SWIVEL CHAIR

This is a continuation, of application Ser. No. 930,530, filed Aug. 2, 1978, which is a continuation of Ser. No. 865,993, filed Dec. 30, 1977, which is a continuation of parent application Ser. No. 718,021, filed Aug. 26, 1976 all of which are abandoned.

BACKGROUND OF THE INVENTION

1. Field of the Invention

This invention relates to a traveling overhead cable transportation system and in particular to a ski lift.

2. Brief Statement of the Prior Art

The common ski lift has a plurality of cable towers spaced at intervals along the direction of travel of the ski lift. The towers support pulleys or wheels which support and guide a traveling, overhead cable. The cable is driven remotely and a plurality of passenger units are suspended from the cable on standards with clamps which secure the units to the cable. The direction of travel of the cable is reversed at turntables located at each end of the lift.

Commonly, the passenger units are a single chair or bench and the passengers are exposed to the elements such as wind, snow and the like and the rigid suspension of the chair prevents the passengers from turning their back to the direction of the travel or direction of the wind or to change their view. The forward facing direction of the passengers is dictated by the necessity for this orientation at the embarking and disembarking stations.

BRIEF STATEMENT OF THE INVENTION

This invention includes, in a ski lift of the aforedescribed type, provisions for the rotation of the passenger unit at the command of the passenger, thereby permitting the passenger to orient the seat at any direction relative to the direction of travel. The invention also includes forward direction restoration means to return the passenger unit to the forward direction together with means to activate the forward direction restoration automatically adjacent the disembarking station.

BRIEF DESCRIPTION OF THE DRAWINGS

The invention will be described with reference to the Figures of which.

DESCRIPTION OF THE PREFERRED EMBODIMENT

Figure 1:
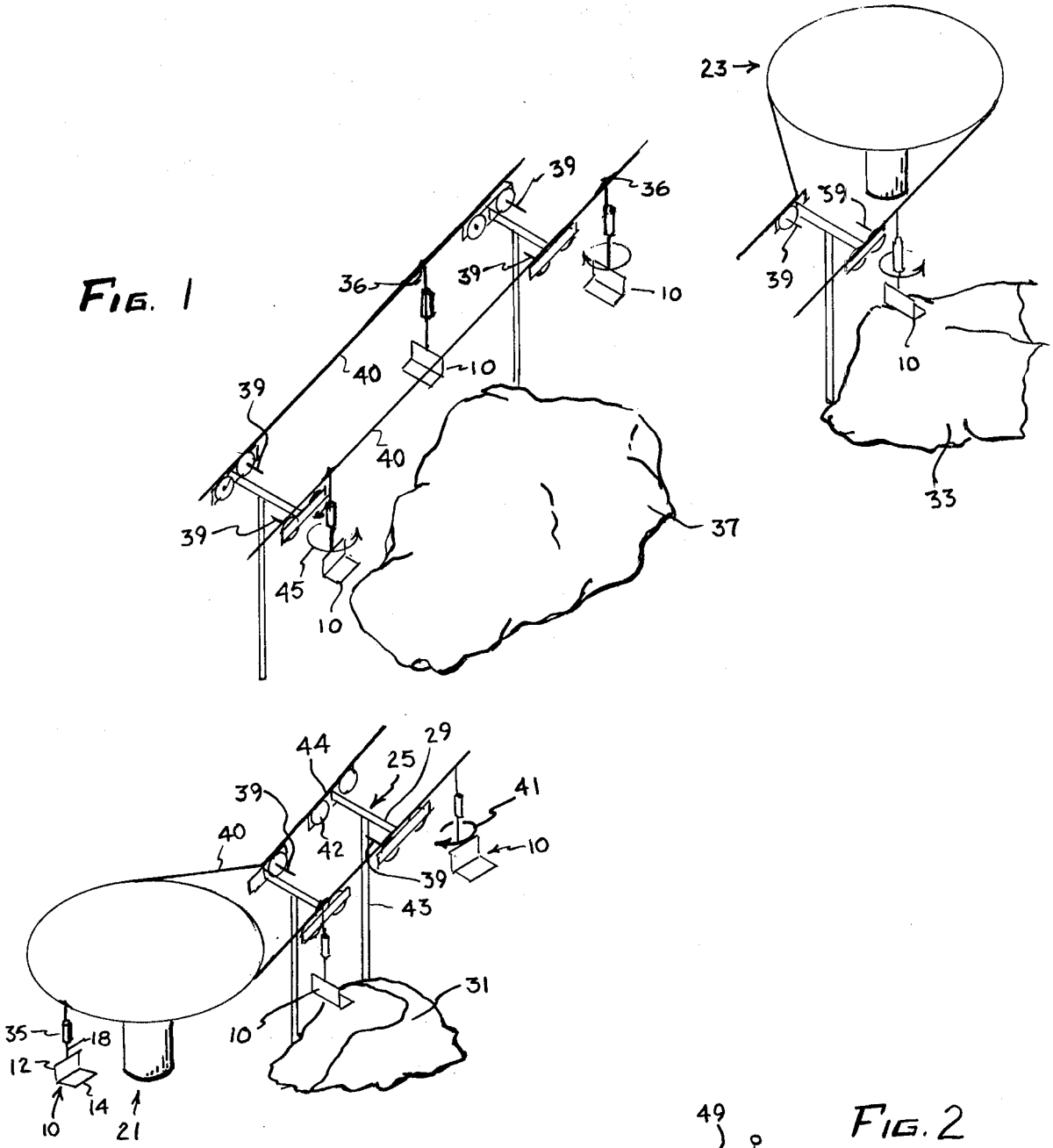
FIG. 1 is a simplified view of a ski lift with the invention.

Referring to FIG. 1, the invention is illustrated applied to a ski lift. The ski lift can be substantially conventional in construction with upper and lower level turntables 21 and 23 and a plurality of lift towers 25 extending therebetween at spaced intervals. Each lift column has a support column 43 and has a cross arm 29 to support the lift cable 40 on a plurality of wheels 42 which are mounted on wheel arms 44.

The passenger units are lift chairs 10 having a back 12 and seat 14 and carried by standards 18 which are secured to cable 40 by clamps 36. The lift extends from the embarking station 31 to one or more disembarking station 33 and may pass over intermediate hazard areas such as out cropping 37. It will be desirable, or even essential, to insure that the lift chairs face in the direction of travel at these stations or hazard areas.

The invention as applied to the ski lift comprises swivel means 35 associated with one or more, preferably all, of the lift chairs. The swivel means, which is described in greater detail hereinafter, includes passenger control means to rotate the passenger unit. Preferably, this rotation is away from adjacent obstructions, e.g., away from the support column 43, as shown by arrowhead lines 41. Preferably, the degree of the rotation is controllable at the will of the passenger. In the preferred embodiment the swivel means includes energy storage means actuated by rotation of the lift chair away from the direction of travel whereby the forward facing direction can be automatically actuated by trip means 39 located at preselected strategic positions along the ski lift.

A trip means 39 can be located on the lift column immediately preceding hazard area 37 to restore the forward facing direction as shown by arrowhead line 45. After the hazard area is cleared the swivel means can again be restored to the passenger control by another trip means 39 located on the lift column 25 following the hazard area.

Trip means 39 are also located on a lift column preceding disembarking station 33. Trip means can also be similarly positioned on the return side of the ski lift to free the swivel mechanism for passenger operation on the return and automatically restoring the forward facing direction near hazard area 37 and as the lift chairs approach the embarking station, e.g., on the lift column adjacent the lower turntable 21.

Figure 2:
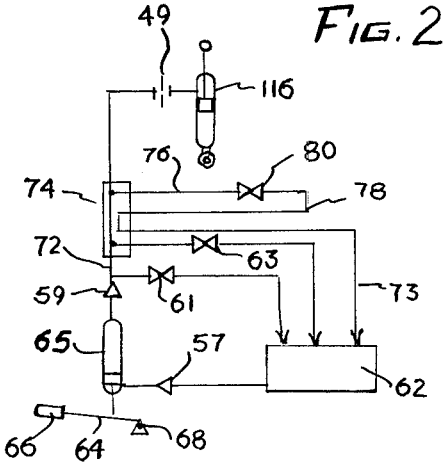
FIG. 2 is a schematic of the swivel actuation system.

In the preferred embodiment, the swivel means comprises hydraulically actuated cam means. The schematic of a suitable hydraulic system is shown in FIG. 2. This system has a hydraulic fluid reservoir 62, a pump 65 with a handle 66 for passenger manual operation. The pump discharges to a hydraulic actuator 116 through line 72 and manifold 74. Check valves 59 and 57 permit the pressured circulation of the fluid. A valve 61 is provided in the bypass line; this valve can be provided with a special key fitting to permit the lift operator to disable the swivel means, removing it from service.

Another valve 63 can be provided in a second bypass line and this valve can have an exposed handle with an instructional placard to permit passenger operation to relieve the hydraulic pressure and restore the forward facing direction. Valves 61 and 63 can be conventional plug valves.

The automatic forward direction restoration means comprises a valve 80 in a bypass line formed of lines 76 and 78, the latter communicating with line 73 through manifold 74 to return fluid to reservoir 62. Valve 80 is preferably a two-position valve which has an actuation lever 82 connected to its valve member by a ratchet mechanism 79.

The hydraulic system can also include an orifice member 49 in the actuator supply to provide a sufficient flow resistance that will slow the rotation of the lift chairs when valve 61, 63 or 80 is opened.

Figure 3:
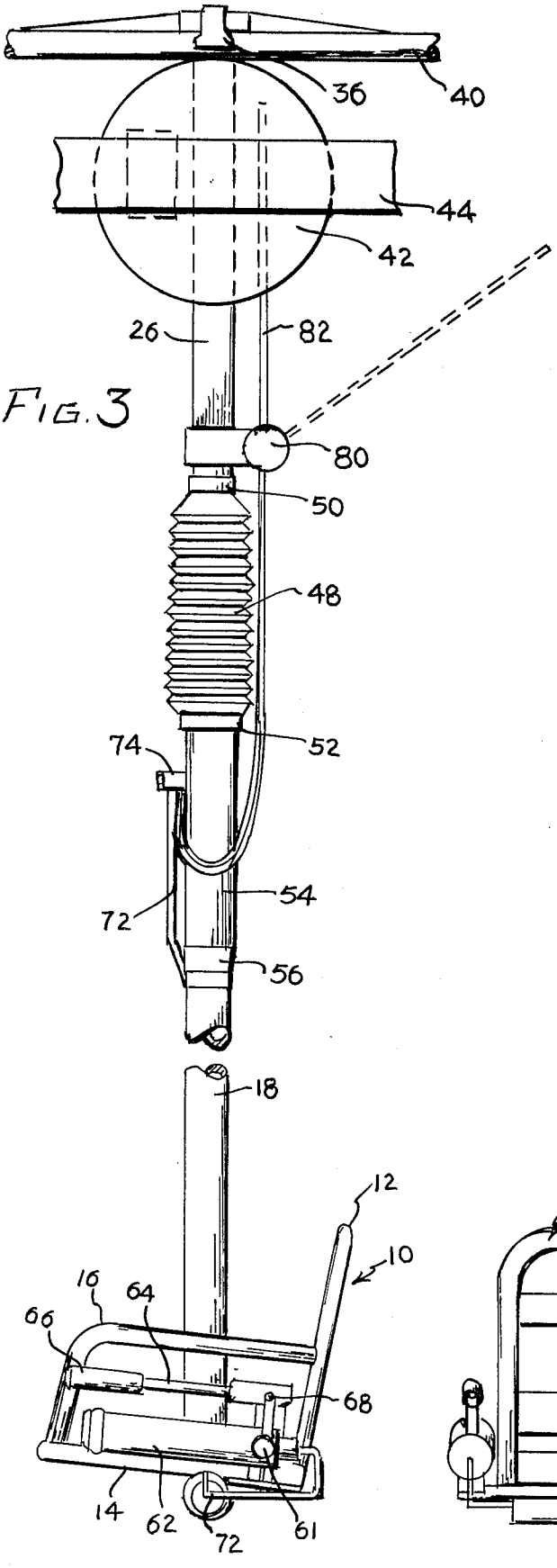
FIGS. 3 and 4 illustrate a single standard chair lift equipped with the invention.
Figure 4:
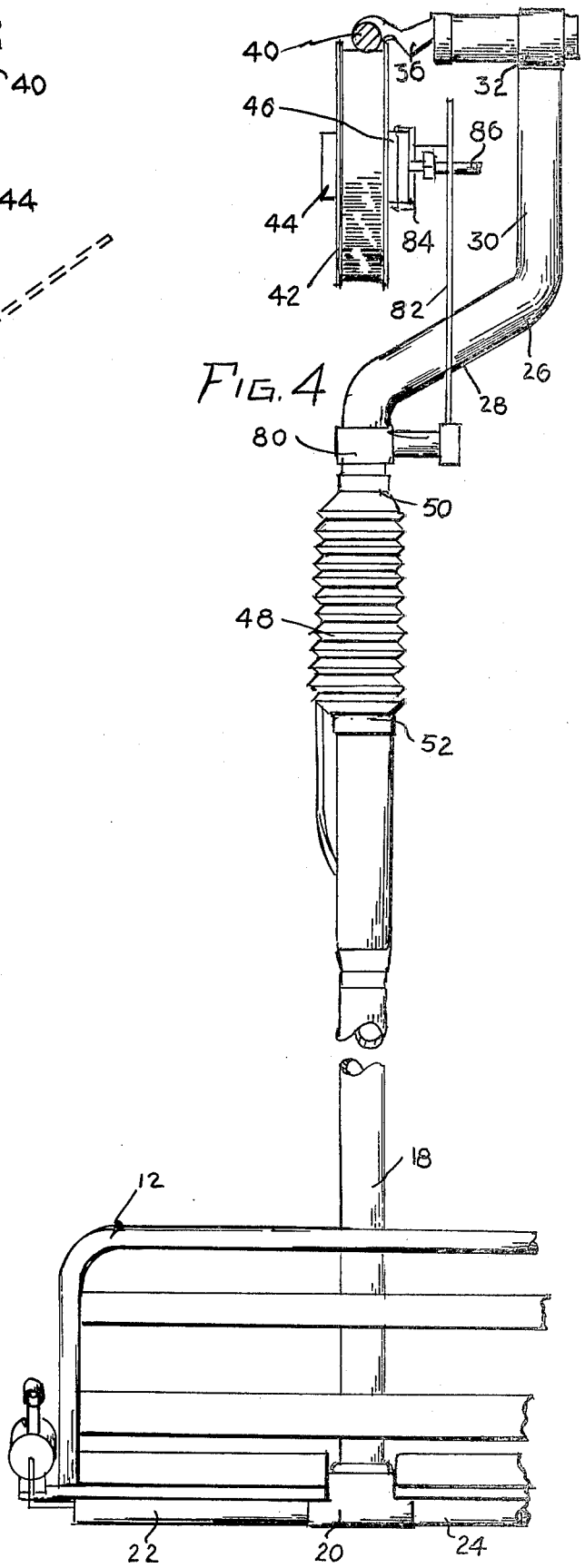

Referring to FIGS. 3 and 4, the invention is shown with reference to a chair of a ski lift having a single standard. The chair 10 is of generally conventional construction having a back 12, seat 14 and arms 16 supported from a single, central standard 18. The standard 18 is generally tubular and is connected with its lower end in a tubular tee 20 having opposite lateral members 22 and 24 for support of the chair 10.

The upper end of the passenger unit is likewise of conventional construction. As illustrated, the upper end 26 of the standard 18 bears a laterally and inclined offset leg 28 and an upright leg 30 which bears a tubular sleeve 32 in which is fitted the horizontal bar 34. A cable clamping mechanism 36 which is permanently secured to cable 40 depends from sleeve 32.

The invention as applied to the aforedescribed chair lift system includes swivel means for permitting the rotation of the passenger unit, chair 10. The swivel means is contained within, and isolated from the atmosphere by, a flexible covering material such as rubber boot 48 which has an upper sleeve 50 which seals about the lower portion of tubular member 26 and a lower sleeve 52 that loosely fits around the tubular member 54. The latter depends on the frusto-conical connecting member 56 which is secured to the upper end of standard 18. As will be described in detail hereinafter, the enlarged tubular section 54 provides for the telescopic reception of the lower end of tubular member 26, permitting the vertical extension and contraction of these members along a helical cam formed as a track in the wall of member 54 whereby the contraction and extension of the telescopic members results in rotation of the passenger unit 10. The rubber boot member 48 accomodates for the contraction and extension of this assembly.

The passenger control means includes motor means to operate the swivel mechanism and rotate the passenger unit. The motor means is provided for remote actuation by the passengers in the passenger unit by the hydraulic hand pump 65 and a reservoir 62. The pump hand lever 64 with a hand grip 66 pivoted for arcuate, pumping movement about pin 68. The pump includes a hydraulic cylinder and piston arrangement driven by lever 64 for the development of hydraulic pressure in the cylinder which is transmitted through line 72 to a hydraulic manifold 74 where it is applied to a hydraulic actuator (not shown) contained within the larger diameter tubular member 54. A suitable and commercially available power unit which includes the pump check valves and reservoir as well as valve 61 is Model 93101 of Walker Manufacturing—Tenneco Co., 1201 Michigan, Racine, Wis. 53402.

As will be described in greater detail hereinafter, one end of the hydraulic actuator 116 is secured to the lower passenger unit, i.e., to tubular member 54 while the opposite end is secured to the upper tubular member 26 whereby contraction and extension of the hydraulic assembly can be controlled by the hydraulic pump.

As previously mentioned, the lift mechanism is provided with forward direction restoration means to return the passenger unit 10 to face the direction of travel. Preferably, means to activate the direction restoration means are provided adjacent in disembarking station and/or hazardous area to insure that the passengers will be facing the direction of travel when they reach the station or area. The forward direction restoration means included in the invention comprises the helical cam and hydraulic cylinder arrangement, which will be discussed in greater detail hereinafter. In the preferred embodiment, the hydraulic pressure developed by the hydraulic pump 65 elevates the chair along a helical cam and thereby stores energy which is available to restore the forward facing direction by simply releasing the hydraulic pressure to rotate the passenger unit. The direction restoration means includes means bypassing the check valve in the hydraulic supply line, including hydraulic lines 76 and 78 which extend to a two-position control valve 80 having an actuator lever 82. The actuator lever 82 is in its upright, vertical position shown in the solid lines of FIGS. 3 and 4. As the chair passes the trip means 39, lever 82 is deflected and moves the two-position valve member in a stepping manner through ratchet mechanism 79.

Referring now to FIG. 4, the actuator lever 82 extends upwardly to a juxtaposition to the cross arm 29 of the control tower. The cross arm 29 is fitted trip means 39 which includes a clamp or bracket 84 which has, dependent therefrom, laterally extending shaft 86 which projects into the path of travel of the actuator lever 82. This arrangement is operative to deflect the actuator lever 82 into the inclined position shown in the broken lines of FIG. 3 as the passenger unit passes bracket 84 and extension shaft 86, thus changing valve 80 from closed to open position and releasing the hydraulic pressure of the actuator piston from high pressure line 76 to the hydraulic fluid return line 78. The latter communicates through manifold 74 to a return line to reservoir 62. Valve 80 remains open until closed when passing another trip means 39.

Figure 5:
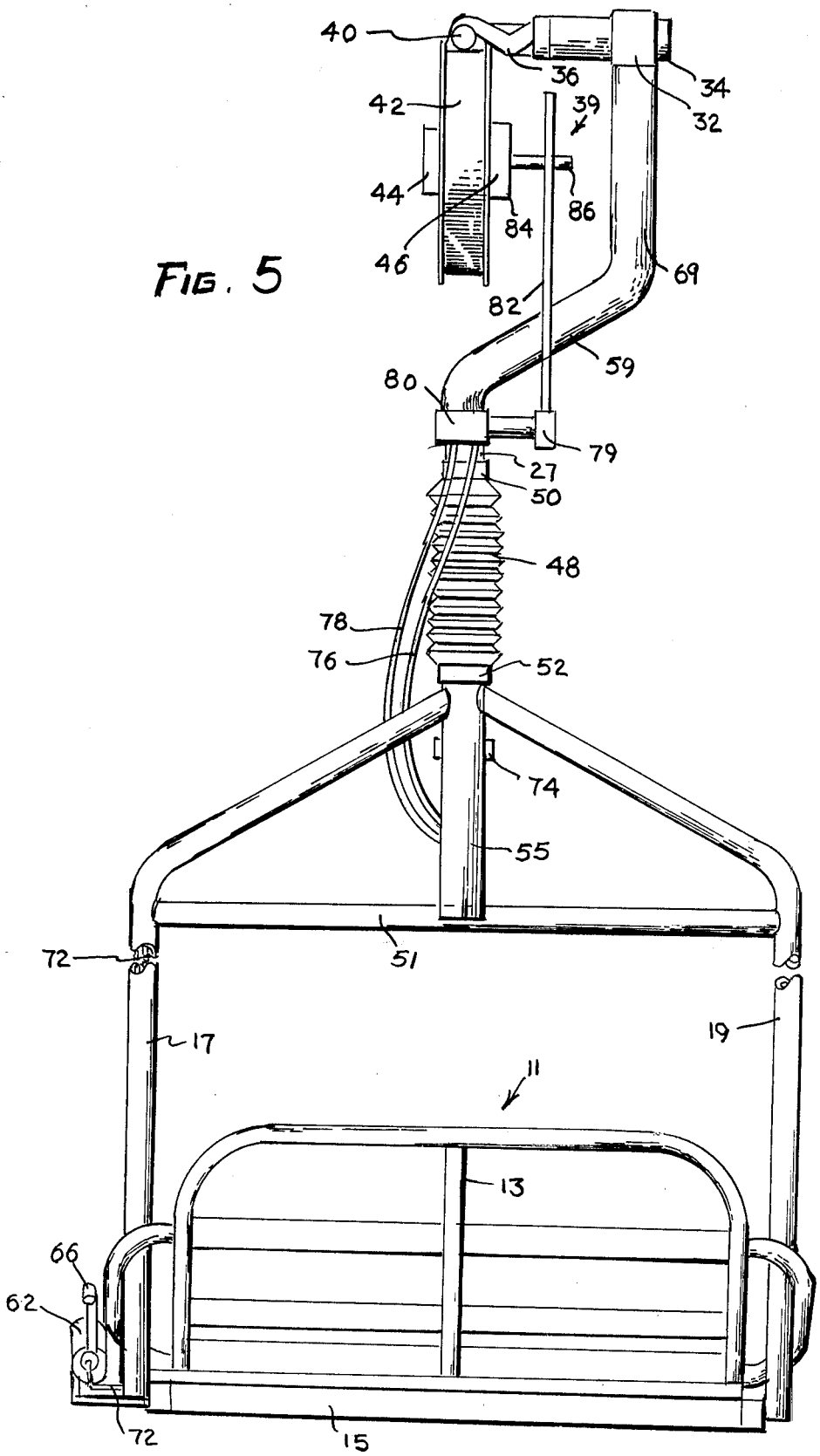
FIG. 5 illustrates a double standard chair lift equipped with the invention.

Referring now to FIG. 5, substantially the same embodiment of the invention can be seen to be incorporated in a double standard passenger unit 11. The passenger unit 11 has a chair back 13 and seat 15 which are dependent from a pair of parallel vertical standards 17 and 19 which extend upwardly for engagement with a short vertical tubular member 55. Tubular member 55, as member 54 of FIGS. 3 and 4, telescopically receives the lower end of smaller diameter tubular standard 27 in a telescopic fit which is contracted and expanded by an internally carried cylinder and piston actuator.

As with the embodiment of FIGS. 3 and 4, the upper tubular member has an inclined laterally offset portion 59 and a short vertical tubular portion 69 extending to the sleeve 32 which receives the cable clamping assembly including horizontal bar 34 and clamp 36 which is fixedly secured to the cable 40. The cable 40 passes over the wheel 42 which is dependent in a journal on cross arms 44 and 46 of the support tower.

The telescopic interconnection of tubular members 55 and 27, including the helical groove of member 55 and cooperative key means carried by member 27, are encased with the rubber boot member 48 having the upper sleeve 50 and lower sleeve 52 which engage about the received tubular members and shield the telescopic assembly from the environment. The mechanism is also provided with the remotely actuated hydraulic pump including reservoir 62, lever 64 and hand grip 66 with a hydraulic pressure supply line 72 that passes into the upright standard 17, tubular cross bar 51 and upwardly through tubular member 55 from where it exits and passes into fluid communicating connection with hydraulic manifold 74.

The passenger unit as thus described is similarly fitted with the forward direction restoration means which includes the hydraulic pressure control valve 80 and the actuator lever 82 that extends vertically into contact with shaft 86 extending from bracket 84 that is carried on cross arm 46 near the disembarking station. The hydraulic control valve 80 is connected to the hydraulic system through the hydraulic hoses 76 and 78 in the manner previously described. The ratchet mechanism 79 provides for the stepping rotation of the two position valve member as the chair passes each trip means 39.

Figure 6:
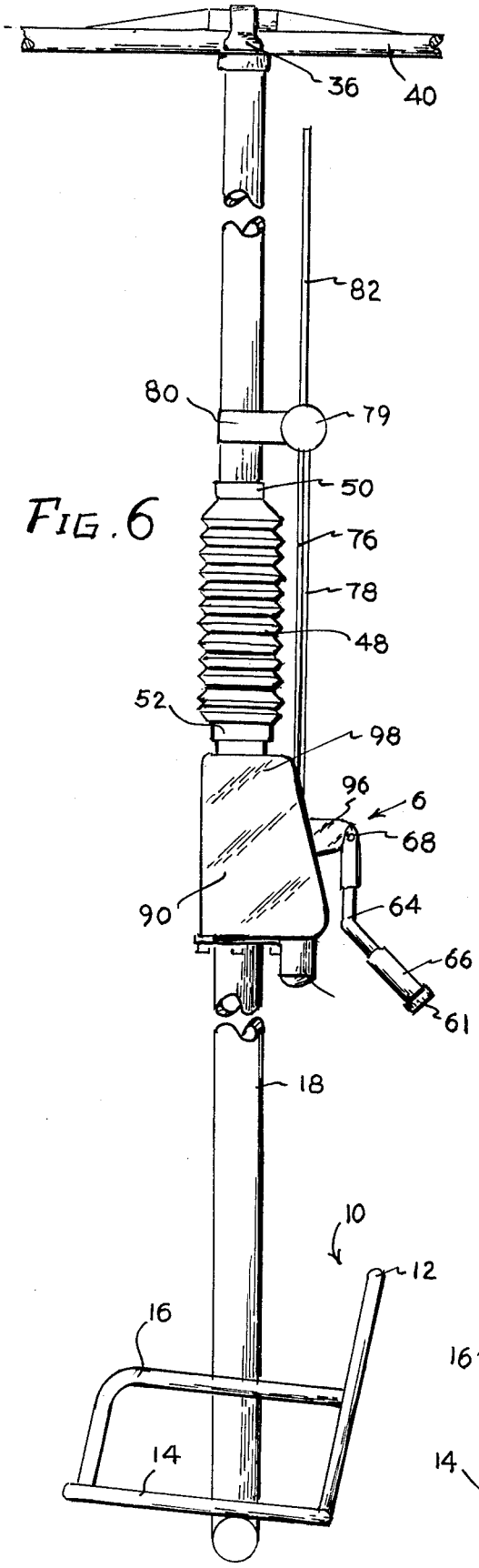
FIGS. 6 and 7 illustrate an alternative embodiment of the invention on a single standard chair.
Figure 7:
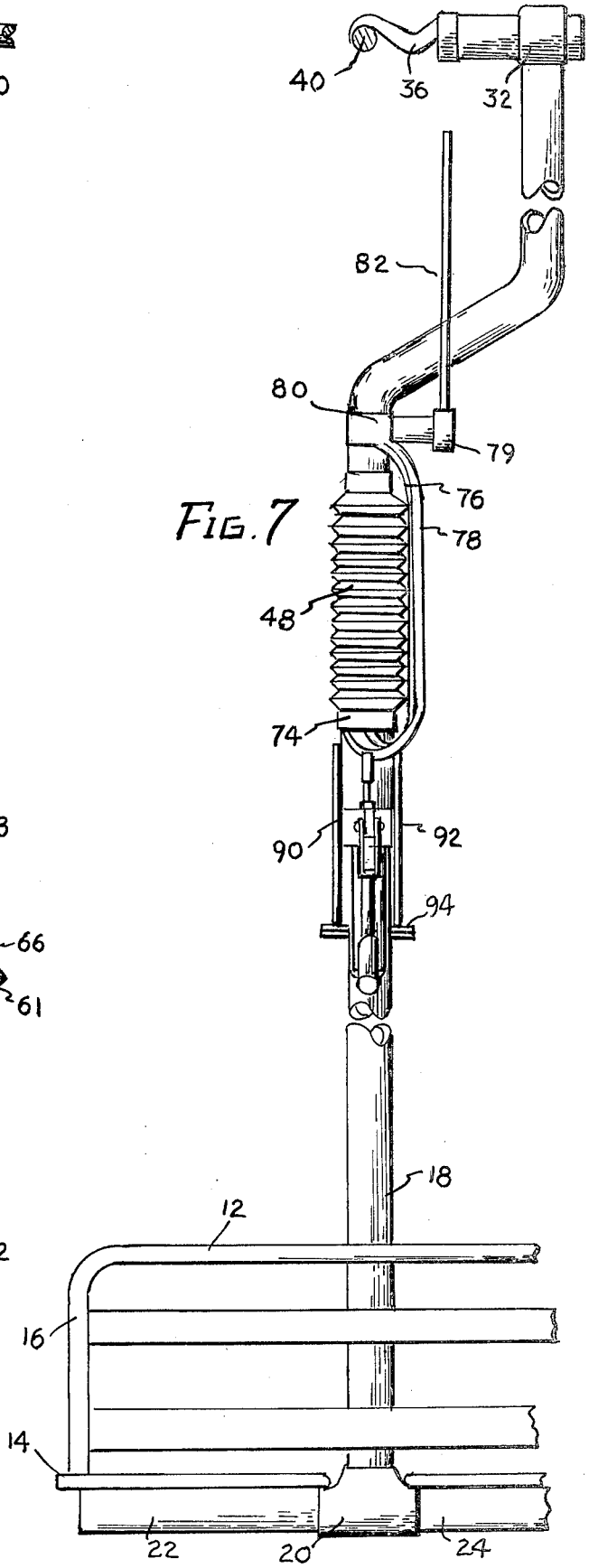

Referring now to FIGS. 6 and 7, the invention is employed with a slightly altered disposition of the hydraulic hand pump. As there illustrated, the passenger unit 10 includes the chair back 12, seat 14 and arm 16 which extends from a central tubular standard 18 similar in construction to that shown in FIGS. 3 and 4. The lower end of tubular member 18 is connected to cross arms 22 and 24 by the tee 20. At an upper portion of tubular standard 18, there is mounted the hydraulic pump unit including reservoir 62 for the swivel means. The pump and reservoir 62 are positioned between lateral flanges 90 and 92 which are mounted on horizontal plate 94. The actuator mechanism includes a hydraulic pump lever 64 and a hand grip 66 dependent thereon which is mounted for pivotal movement about pin 68 carried by bracket 96. The actuation of lever 64 moves a piston within the hydraulic pump cylinder and the resultant pressure is applied to a hydraulic actuator contained within the upper end of tubular member 18. As with the mechanism previously described, the swivel mechanism is entirely encased and isolated from the environment by rubber boot 48 having an upper sleeve 50 and lower sleeve 52 which operate as before described. The swivel mechanism also includes manifold 74 which distributes the hydraulic fluid in the manner previously described and has forward direction restoration means, valve 80 coupled by ratchet mechanism 79 to lever 82 with hoses 76 and 78 which extend between valve 80 and manifold 74. The remainder of the chair lift unit is as previously described for the units shown in FIGS. 3 through 5.

Figure 8:
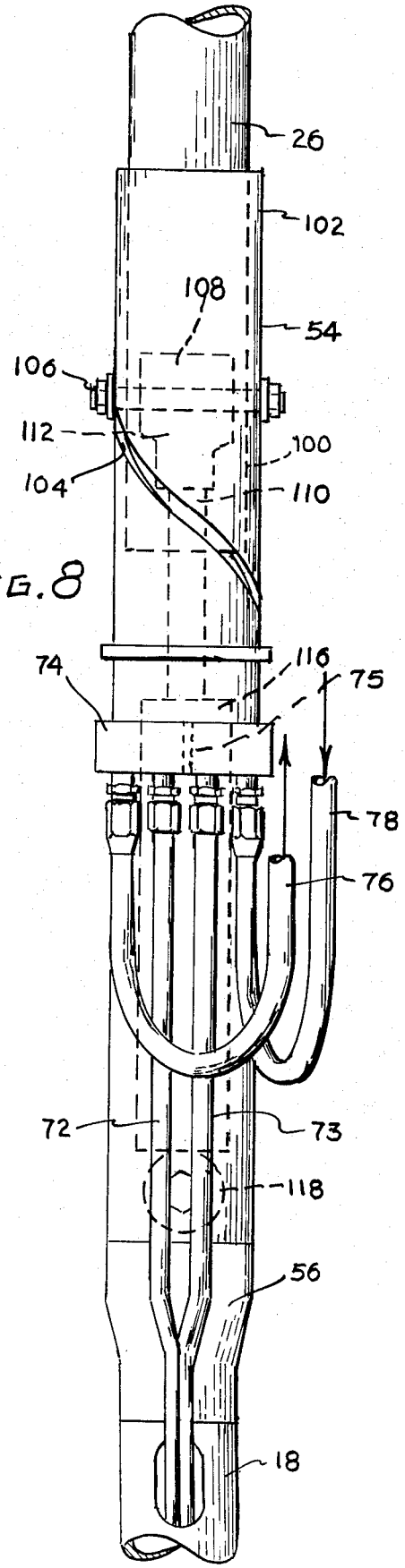
FIGS. 8 and 9 illustrate the swivel mechanism of the invention.
Figure 9:
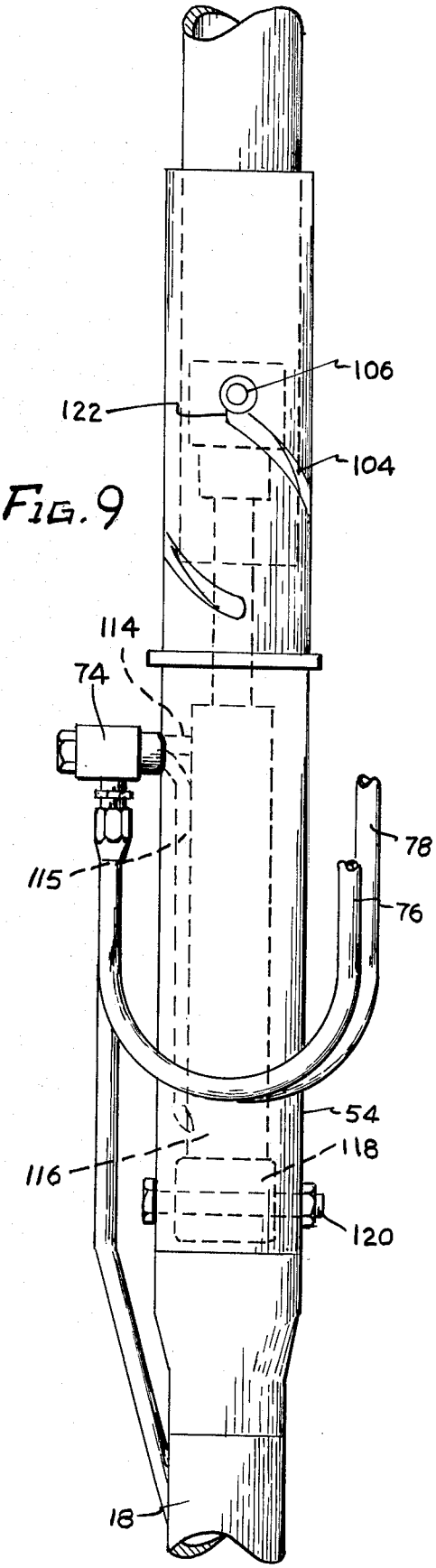

Referring now to FIGS. 8 and 9, the swivel mechanism is illustrated with the rubber boot 48 removed for purposes of illustration. As there illustrated, the unit will be described with reference to the passenger unit shown in FIGS. 3 and 4. The lower end 100 of upper tubular member 26 projects into and terminates within the upper portion 102 of the larger diameter, outer tubular member 54. As previously described member 54 is connected to tubular standard 18 by the frusto-conical connector 56. The upper portion 102 of tubular member 54 bears a cam in the form of a helical slot or groove 104 that forms a track for the sliding reception of hanger bolt 106. Bolt 106 extends through bores in the lower end of tubular member 26 and through a clevis member 108. Member 108 receives, preferably by threaded engagement, the upper end of rod 110 in its boss 112.

Rod 110 extends downwardly to the cylinder and piston actuator generally shown at 116. Rod 110 is the piston rod of the assembly and is attached to a piston within the hydraulic cylinder.

The lower end of the hydraulic cylinder bears a cylindrical mounting lug 118 that has a central bore to receive bolt 120 that extends through apertures in the sidewall of tubular member 54 whereby the cylinder is fixedly secured to tubular member 54.

The helical track 104 can, as shown in FIG. 9, have a short, axial leg 122 whereby the hanger bolt 106 can be fixedly captured and retained against rotation when in its fully extended or relaxed position.

The hydraulic fluid manifold 74 extends into fluid communication with the upper port of the cylinder of actuator 116 through passage 114. and 115. The hydraulic actuator system includes the high pressure hydraulic supply line 72 and a hydraulic fluid return line 73 which communicate to ports in the hydraulic cylinder of the hand pump 65; see FIG. 2. The pressure of hydraulic fluid developed in the pump is applied through line 72 and a port of manifold 74 to the upper surface of the piston within the actuator assembly, whereby the piston is withdrawn and the assembly is contracted, raising the outer tube 54 and causing this tube to rotate as the helical slot 104 slides about the outer ends of the hanger bolt 106. The fluid manifold 74 is provided with an internal wall 75 which isolates the high and low pressure slides of the manifold. Although not shown in FIGS. 8 and 9, the manifold can house the orifice 49 previously described and shown in FIG. 2.

The high pressure applied to the upper side of the piston of the hydraulic actuator is also transmitted through line 76 to the control valve 80, previously described, and hydraulic fluid returned to the system from this control valve is passed through line 78 that communicates with the low pressure side of hydraulic manifold 74 and return line 73.

The angular orientation of the cam means, helical groove 104, in the outer tubular member 54, illustrated in FIG. 8, is such that the actuation of the hydraulic hand pump 62 will effect rotation of the chair unit in the direction of the solid arrow headed lines 41 shown in FIG. 1, in a direction to rotate the passengers away from the tower column 43 so that the passengers, skis or limbs do not become entangled with this tower during rotation of the passenger unit and/or its passage past the tower column 130. In the preferred embodiment, this rotation elevates the passenger unit in the assembly, thereby storing potential energy for automatic restoration of the forward facing direction.

Typically, the passenger unit can be rotatable through a complete, 360 degree, turn. Preferably, the lift chair can be rotated through an angle of at least 180°, thereby providing the passenger with complete control of their position so they can orient their backs to the weather, wind, blowing snow, and the like.

When the passenger unit reaches or approaches the disembarking station, the control valve 80 is operative, under the guidance of the actuator lever 82, to open and release the high pressure hydraulic fluid from the actuator for return to the reservoir 62. This permits the actuator hydraulic assembly to relax and assume its extended position, lowering the passenger unit along the path of the helical groove 104 and causing opposite, rotational movement in the direction indicated by the arrowhead lines 45 of FIG. 1. This restores the forward facing direction of the passenger unit and again moves the occupants in a rotational direction away from the support tower columns to insure against entanglement with the columns.

The invention has been described with reference to the presently illustrated and preferred embodiment thereof. It is not intended that the invention be unduly limited by the illustration of the preferred embodiments. Instead, it is intended that the invention be defined by the means, and their obvious equivalents, set forth in the following claims.

What is claimed is:

1. In a ski lift including a plurality of cable towers spaced along a lift path between embarking and disembarking stations with wheel supports offset to one side thereof for suspension of a traveling overhead cable therebetween, cable drive means, and a plurality of passenger units, each unit suspended therefrom by a standard having a cable attachment means, the improvement comprising:

(a) at least one passenger unit bearing swivel means dependent from its respective standard;

(b) swivel motive means actuable by a passenger during passenger transit to operate said swivel means and selectively rotate said passenger unit from facing the forward path of direction of said unit, said swivel motive means including a hydraulic cylinder and piston actuator and is operative to elevate said passenger unit along a cam guide means carried by its respective standard with said respective standard including a sleeve bearing a helical track and receiving concentric tubing having key means within said track and said passenger unit carrying hydraulic pump means with hydraulic supply and return lines extending to said cylinder and piston actuator;

(c) forward direction restoration means to return said unit to face said path of direction, said forward direction restoration means actuating said swivel means to reverse the rotation of said passenger unit; and (d) control means located along said lift path to automatically activate said direction restoration means and restore said unit facing forward at a preselected location along the passenger transit of said lift path.

2. The ski lift of claim 1 wherein said passenger unit is dependent from said sleeve and said concentric tubing depends from said cable attachment means and bears hanger bolt means that engage said helical track, said sleeve and said tubing being connected to opposite ends of said hydraulic cylinder and piston actuator assembly.

3. The ski lift of claim 1 wherein said rotation of said passenger unit is effected by supply of pressurized hydraulic fluid through said supply line to said hydraulic cylinder and piston actuator assembly to contract said assembly.

4. The ski lift of claim 3 wherein said forward direction restoration means includes valve means to release hydraulic pressure from said cylinder and piston actuator and permit said passenger unit to descend along said helical track.

5. The ski lift of claim 1 wherein said helical track bears an axially aligned upper end to capture said key and lock said passenger unit in the forward facing direction.

6. In a ski lift including a plurality of cable towers spaced along a lift path between embarking and disembarking stations which support an overhead traveling cable therebetween and one or more passenger units suspended therefrom by standards having a cable attachment means, the improvement comprising:

a passenger unit bearing swivel means dependent from its respective standard;

swivel motive means selectively actuable by a passenger during passenger transit to operate said swivel means and rotate said passenger unit to rotational positions selected by said passenger; and means for locking said passenger unit in any of said selected rotational positions during passenger transit.

7. The ski lift of claim 6 further including means for returning said unit from said selected rotational positions to face the forward path of direction of said passenger unit.

8. In a ski lift including a plurality of cable towers spaced along a lift path between embarking and disembarking stations which support an overhead traveling cable therebetween and one or more passenger units suspended therefrom by standards having a cable attachment means thereon, the improvement comprising:

a passenger unit including swivel means dependent from its respective standard;

swivel motive means selectively operable by said passenger to rotate said passenger unit to any orientation selected by said passenger during passenger transit; and forward direction restoration means to return said unit from said passenger selected orientations to face said path of direction.

* * * * *

UNITED STATES PATENT AND TRADEMARK OFFICE

CERTIFICATE OF CORRECTION

PATENT NO. : 4,246,848

DATED : January 27, 1981

INVENTOR(S) : Donald C. Schneider

It is certified that error appears in the above—identified patent and that said Letters Patent is hereby corrected as shown below:

On the Title Page, Item (76), "342 St. Joseph, Long Beach, Calif. 90814" should read -- P. O. Box 9063, Mammoth Lakes, Calif. 93546 --.

Column 6, line 1, "114." should read -- 114 --.

Signed and Sealed this

*Ninth* Day of *June 1981*

[SEAL]

*Attest:*

RENE D. TEGTMEYER

*Attesting Officer* *Acting Commissioner of Patents and Trademarks*